US005236125A

United States Patent [19]

Young et al.

[11] Patent Number: 5,236,125

[45] Date of Patent: Aug. 17, 1993

[54] GUARD RAIL ASSEMBLY SUPPORT BLOCK

[75] Inventors: Keith Young, Naperville, Ill.; James A. Remington, Superior, Wis.

[73] Assignee: ABC Rail Corporation, Chicago, Ill.

[21] Appl. No.: 898,410

[22] Filed: Jun. 15, 1992

Related U.S. Application Data

[62] Division of Ser. No. 825,557, Jan. 24, 1992, Pat. No. 5,176,318.

[51] Int. Cl.[5] ..... E01B 5/00

[52] U.S. Cl. ..... 238/17; 104/242

[58] Field of Search ..... 104/242; 238/17, 18, 238/19, 20, 21, 22, 23, 285, 355

[56] References Cited

U.S. PATENT DOCUMENTS

| | | | |
|---|---|---|---|
| 457,518 | 8/1891 | Morrell | 238/285 |
| 658,131 | 9/1900 | Swanson | 238/355 |
| 1,126,528 | 1/1915 | Liebmann | 238/20 |
| 3,716,114 | 2/1973 | Beck | 238/17 |

*Primary Examiner*—Robert J. Oberleitner
*Assistant Examiner*—Kevin D. Rutherford
*Attorney, Agent, or Firm*—Thomas S. Baker, Jr.

[57] ABSTRACT

A support block for a guard rail assembly has a vertical wall with non parallel front and rear surfaces. A pair of spaced legs project laterally from the front surface of the vertical wall. One of the legs has inner and outer side walls which are joined by an outer end wall. The inner and outer side walls extend different distances from the front surface such that the outer end wall tapers and is non parallel to the front surface.

3 Claims, 3 Drawing Sheets

GUARD RAIL ASSEMBLY SUPPORT BLOCK

BACKGROUND OF THE INVENTION

This application is a division of patent application Ser. No. 07/825,557 filed Jan. 24, 1992 now U.S. Pat. No. 5,176,318.

A guard rail functions to align the wheels on railroad car axle sets to prevent damage to other trackwork components and to ensure that the wheel set tracks a particular path where a wheel may have a tendency to derail or where a derailment would be a particular safety hazard. Guard rails may be inserted in railroad trackwork adjacent the high side of curves, across bridges, adjacent turnout frogs and at elevated sections of trackwork for transit systems. At turnout frogs, guard rails are utilized to divert the path of one wheel of a railroad car axle set in such a manner as to cause the opposite wheel to be drawn away from the point of the turnout frog. If guard rails are not utilized at turnout frogs, a railroad car wheel passing through the frog, particularly a wheel which is worn, may strike the point of frog and thereby cause undesired wear or damage to the frog point as is well known in the art. Thus, a guard rail may be defined as a trackwork assembly which diverts or sets the path of one wheel of a railroad car axle set in such a manner as to cause the opposite wheel to track a desired path.

Traditionally guard rails have been non-adjustable and have required replacement when the guard rail face has worn to the point that it no longer properly guides the path of the non-guarded wheel of a railroad car axle set. Many guard rails have been formed from lengths of track rail which was laid parallel to the running rail to be guarded. Installation of the heavy track rail was difficult and somewhat imprecise. In many instances the guard rail assembly was mounted on the same tie plates as that of the traffic rail thus linking the installation points of the guard rail to the tie spacing.

In some instances, the guard rail has been fastened to the traffic rail. Such fastening often required drilling of the running rail in the field. This made installation of the guard rail difficult under the best of conditions and extremely difficult under adverse conditions such as bad weather or where electrical power was unavailable to the trackwork installation crew.

More recently, rolled steel guard bars have replaced sections of track rail in guard rail assemblies. The guard bars are mounted on a bracket or brace and provide a guard face which extends parallel to the gage line of a running rail. Inasmuch as the guard bars and the support brackets or braces are separate items only the guard bar has to be replaced when the guard face wears beyond an acceptable limit.

In most instances, guard rail assemblies do not have an adjustment which compensates for the wear of the guard face of a guard bar. In those assemblies which do provide an adjustment to compensate for wear of the guard face, the adjustment typically is awkward and requires a lengthy disassembly of the guard rail assembly.

Some non-adjustable guard rails are spiked directly to the wooden ties which support the tie plates for the traffic rails. However, in most instances adjustable and non-adjustable guard rail assemblies are secured to tie plates for traffic rails or directly to the traffic rails themselves by threaded fasteners or by welding. Threaded fasteners are disadvantageous inasmuch as they require a high level of maintenance due to their tendency to loosen over a period of time. As mentioned previously, those guard rail assemblies which are affixed to the running rail and require drilling of the running rail are extremely time consuming and difficult to install and maintain. Those guard rail assemblies which are spiked directly to railroad ties suffer from the disadvantage that over a period of time during which the guard rail assembly is replaced the railroad ties tend to become spike killed and must be replaced.

From the above, it may be observed that it is desirable to provide a guard rail assembly utilizing a replaceable guard bar which may be installed and adjusted easily without regard to tie spacing and which utilizes an elastic fastener.

SUMMARY OF THE INVENTION

The instant invention provides a guard rail assembly for mounting a guard bar having a vertical body element, a guard face which extends laterally from the body element and a horizontal foot which extends laterally from the body element. The guard rail assembly has a guard rail plate and a support bracket affixed to the guard rail plate with a front shelf adapted to mount a guard bar, a horizontal hook support, a front surface which faces the guard bar, a rear surface which faces away from the guard bar and a rear shelf adapted to receive a support block. The assembly also incorporates a hook having a front end adapted to engage a lower horizontal foot on the base of the guard bar, a bottom surface adapted to engage the horizontal hook support and a fastener receptacle at the rear end thereof. The assembly also has a support block having a bottom surface adapted to engage the rear shelf, a first vertical surface adapted to engage the fastener receptacle, a second vertical surface adapted to engage a fastener and a rear surface which faces the rear surface of the support bracket. An elastic fastener having first end adapted to be received in the fastener receptacle of the hook and a second end adapted to contact the second vertical surface of the support block acts to simultaneously draw the hook and the guard bar toward the front surface of the support bracket.

DESCRIPTION OF THE PREFERRED EMBODIMENT

Figure 1:
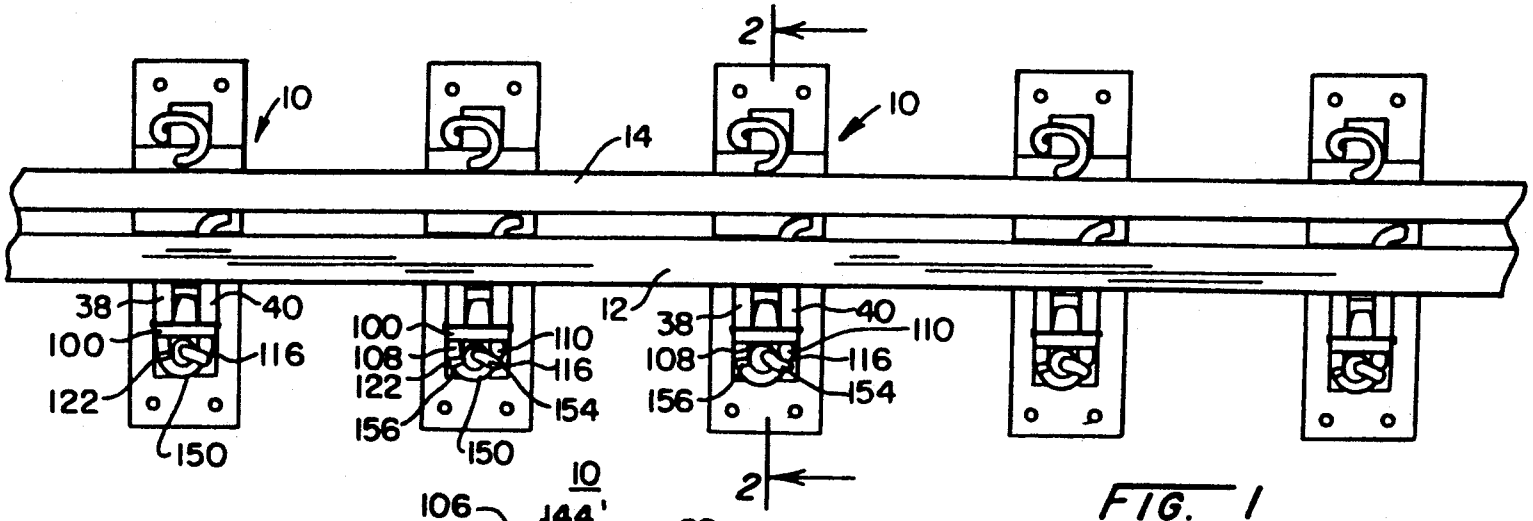
FIG. 1 is a plan view showing a plurality of guard rail assemblies mounted adjacent a section of running rail.
Figure 2:
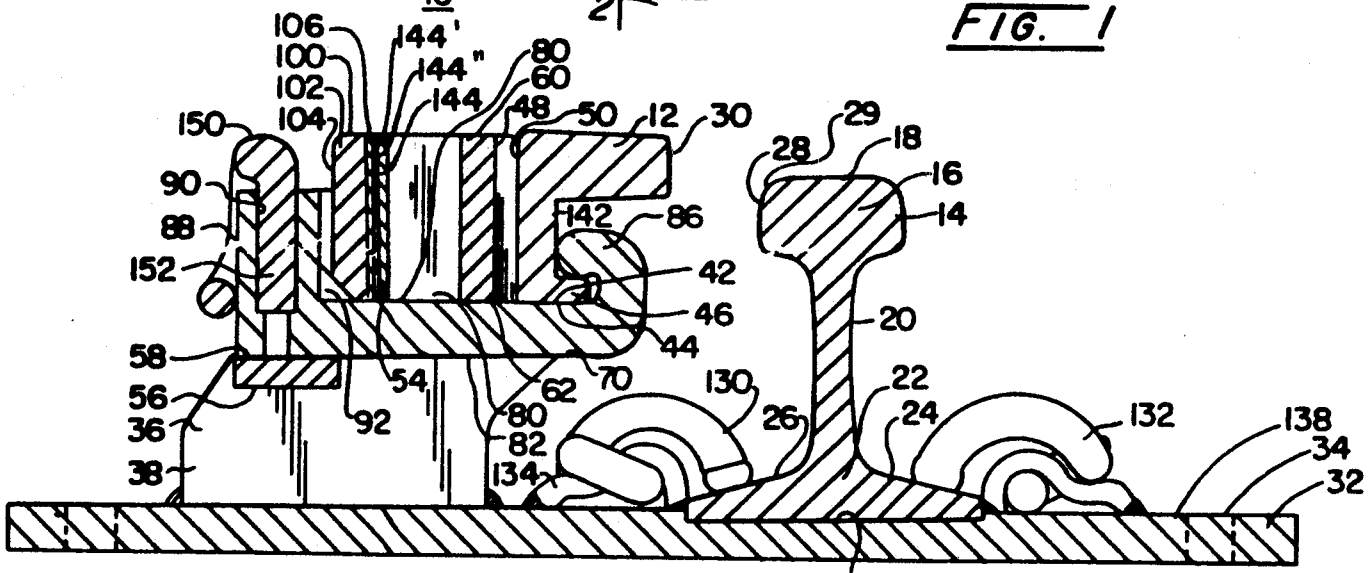
FIG. 2 is a sectional view along line 2—2 of FIG. 1.

Referring to FIG. 1 of the drawings, a plurality of guard rail assemblies (10) are shown supporting a guard bar (12) adjacent a running rail (14). Turning to FIG. 2, it may be observed that rail (14) has a head (16) with a top or running surface (18), a web (20) and a base (22) having a pair of oppositely inclined fishing surfaces (24 and 26). The head (16) of rail (14) has a substantially vertical side surface (28) which faces a substantially vertical guard face (30) formed on guard bar (12). When the tread of a railroad car, not shown, travels across running surface (18) the flange of the wheel travels in the space between side surface (28) and guard face (30). Gage corner (29) of side surface (28) and guard face (30) set the path of the wheel such that the opposite wheel tracks a desired path.

The guard rail assembly (10) of the present invention is supported upon a metal rail plate (32). Plate (32) has a plurality of bores (34) so that it may be spiked to a railroad tie, not shown.

Figure 4:
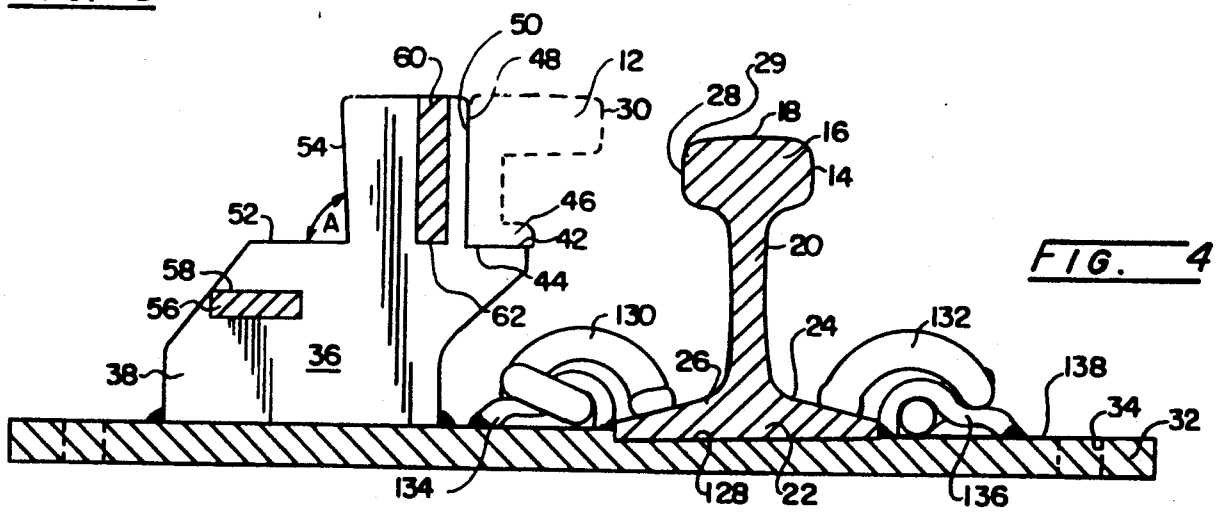
FIG. 4 is a view similar to FIG. 3 showing a support bracket with the guard bar, hook, support block, shims and elastic fastener removed.

Guard rail assembly (10) has a support bracket (36) formed of a pair of laterally spaced vertical side walls (38 and 40) which are welded to rail plate (32) as shown in FIG. 1. The side walls (38 and 40) are identical. This description will proceed with respect to side wall (38) and identical elements on side wall (40) will be identified by identical primed numbers. Turning to FIG. 4, it may be seen that side wall (38) has a horizontally extending front shelf (42) adapted to support a guard rail (12) by receiving the bottom surface (44) of a horizontal foot (46) and a vertical front surface (48) adapted to engage the vertical rear surface (50) of the guard rail (12). Vertical side wall (38) also has a horizontally extending rear shelf (52) and a substantially vertical rear surface (54) which intersects shelf (52). It may be observed that angle A formed by the intersection of horizontal surface (52) and vertical surface (54) is slightly less than 90 degrees.

A horizontal shelf or hook support (56) having a top surface (58) extends between the vertical side walls (38 and 40). Similarly a vertical shelf or guide (60) having a lower guide surface (62) also extends between the vertical side walls (38 and 40). Horizontal shelf (56) and vertical shelf (60) may be welded to side walls (38 and 40). Shelves (56 and 60) and side walls (38 and 40) also may be cast as one piece. Support bracket (36) functions primarily to mount guard bar (12) by placing the bottom surface (44) of horizontal foot (46) on the horizontal front shelf (42) and having the vertical rear surface (50) of guard bar (12) engage the vertical front surface (48) of support bracket (36).

Figure 5:
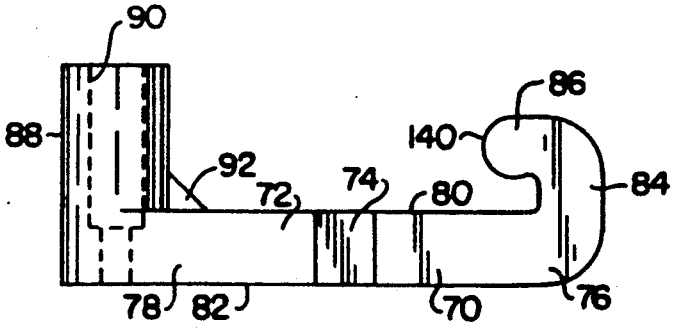
FIG. 5 is a side view of a hook.

Guard rail assembly (10) includes a hook (70) which acts to retain guard bar (12) on the front shelf (42) of support bracket (36). Turning to FIG. 5, it may be seen that hook (70) has a longitudinally extending central section (72) which is tapered at its mid point (74) such that the front end (76) is somewhat narrower than the rear end (78). Hook (70) has a generally flat top surface (80) and a generally flat bottom surface (82). The front end (76) of hook (70) terminates with a vertical leg (84) and a horizontal leg (86) which extends rearwardly and overlies the top surface (80). The rear end (78) of hook (70) mounts a cylindrical fastener receptacle (88) which projects upwardly from top surface (80). Receptacle (88) has a stepped bore (90) adapted to receive a fastener as will be described hereinbelow. A narrow, centrally located rib (92) reinforces the connection of the base of fastener receptacle (88) to top surface (80) and provides centering guidance for assembly purposes.

Figure 3:
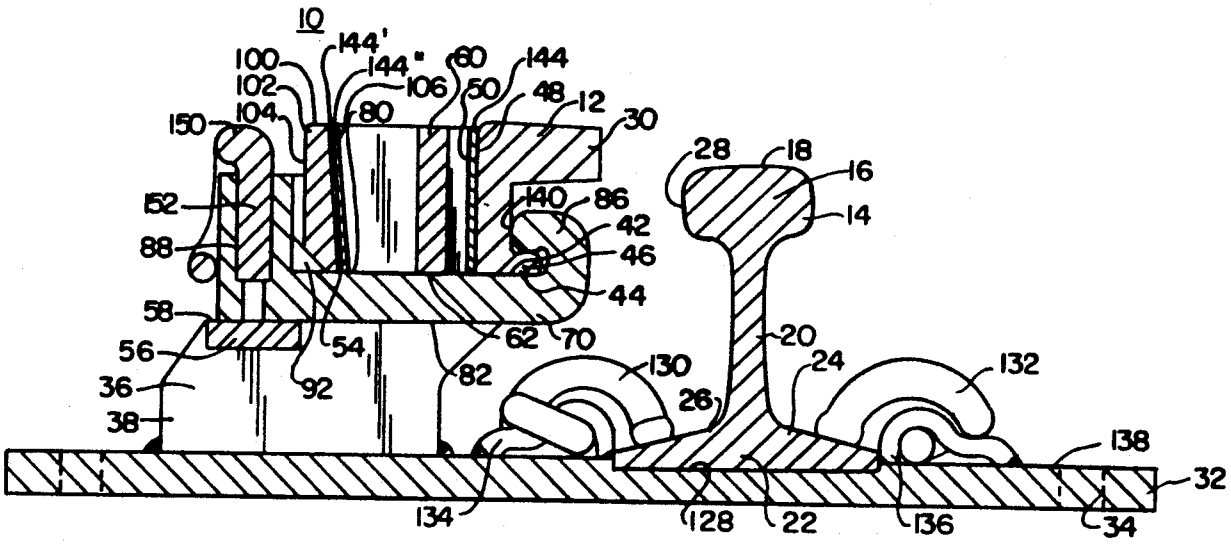
FIG. 3 is a view similar to FIG. 2 illustrating the use of an adjustment shim to compensate for wear of the guard rail.

Turning to FIGS. 2 and 3, it may be observed that in use hook (70) functions to retain guard bar (12) on support bracket (36) by having horizontal leg (86) overlie the foot (46) of bar (12). Thereafter, the bottom surface (82) of hook (70) rests upon the top surface (58) of horizontal shelf or hook support (56) and top surface (80) of hook (70) engages the guide surface (62) formed on the bottom of vertical shelf (60).

Figure 6:
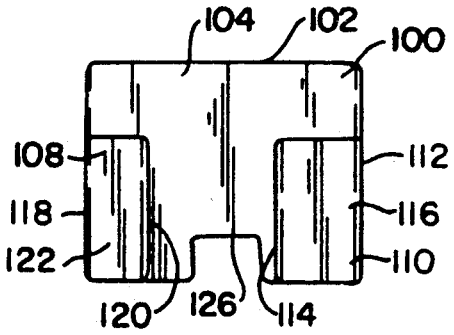
FIG. 6 is a front view of a support block.
Figure 7:
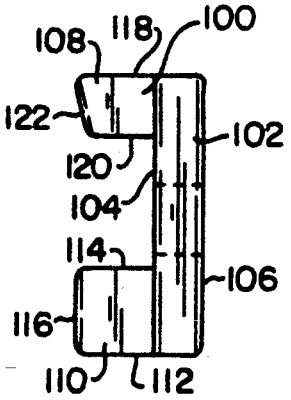
FIG. 7 is a top view of a support block.
Figure 8:
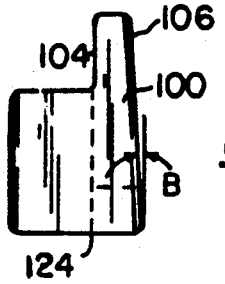
FIG. 8 is a side view of a support block.

Guard rail assembly (10) utilizes a fastener block or support block (100) to lock hook (70) into position after it has engaged the foot (46) of guard bar (12). Turning to FIGS. 6 through 8, it may be seen that fastener block (100) has a vertical rear wall (102) having front and rear surfaces (104 and 106) respectively. From FIG. 7 and 8 it may be observed that rear surface (106) is tapered from top to bottom. In fact, angle B which is equal to the number of degrees rear surface (106) is offset from vertical is identical to angle A which is formed between horizontal rear shelf (52) and vertical rear surface (54). A pair of legs (108 and 110) project from the front surface (104) of fastener block (100). The outer side wall (112) and the inner side wall (114) of leg (110) project the same distance from front surface (104) such that the outer end wall (116) extends parallel to surface (104). In contrast thereto, the outer side wall (118) of leg (108) extends a greater distance from front surface (104) than inner side wall (120) such that the outer end wall (122) of leg (108) is tapered inwardly. Fastener block or support block (100) has a relatively flat bottom surface (124) adapted to rest upon the horizontal rear shelf (52) of support bracket (36). Additionally, fastener block (100) has a notch (126) formed centrally in the lower portion thereof between legs (108 and 110). Turning to FIGS. 2 and 3, it may be observed that rib (92) of hook (70) resides within the space created by notch (126) when hook (70) rests upon horizontal shelf (56) and the bottom surface (124) of fastener block (100) rests upon the rear shelf (52) of support bracket (36).

The assembly of guard rail assembly (10) to mount a guard bar (12) parallel to running rail (14) may be seen by referring to FIGS. 2 through 4. Initially, rail plate (32) is positioned on a railroad tie not shown beneath running rail (14) such that the base (22) of running rail (14) fits into a rail seat (128) formed on the top surface (128) of plate (32). Thereafter, elastic fasteners (130 and 132) are driven into shoulders (134 and 136) welded to top surface (138) of plate (32). Spikes not shown are driven through bores (34) to attach plate (32) to a tie, not shown, after the gage of rail (14) has been determined. Thereafter, guard bar (12) is placed on support bracket (36) such that the bottom surface (44) of horizontal foot (46) rests upon front shelf (42). Preferably the vertical rear surface (50) of guard bar (12) is moved into engagement with the vertical front surface (48) of support bracket (36) if a shim is not required between the two surfaces. Subsequently, hook (70) is inserted in the opening in support bracket (36) formed between vertical side walls (38 and 40) between guide surface (62) at the bottom of vertical shelf (60) and the top surface (58) of horizontal shelf (56). This requires hook (70) to be inserted at an angle of approximately 45 degrees with respect to the top surface (138) of plate (32). After the front end (76) of hook (70) has passed beyond the outer end of foot (46) on guard bar (12) hook (70) is rotated counterclockwise and moved horizontally towards guard bar (12) to cause the horizontal leg (86) of hook (70) to overlie the horizontal foot (46) of guard bar (12). Hook (70) is moved horizontally until the curved outer end (140) of horizontal leg (86) engages either the vertical front surface (142) or the horizontal foot (46) of guard bar (12). In this position, the bottom surface (82) of hook (70) rests upon the top surface (58) of horizontal shelf (56) and the top surface (80) of hook

(70) lies beneath the guide surface (62) on vertical shelf (60).

Subsequent to installation of the hook (70), support block or fastener block (100) is installed such that the rear surface (106) faces the vertical rear surface (54) formed on support bracket walls (38 and 40), legs (108 and 110) are positioned on opposite sides of hook fastener receptacle (88) and the bottom surface (124) engages rear shelf (52) formed on support bracket walls (38 and 40).

When guard bar (12) is new a plurality of shims (144, 144' and 144") which may have different thicknesses are mounted on support bracket (36) between its vertical rear surface (54) and rear surface (106) of fastener block (100) as shown in FIG. 2. In this position guard face (30) of guard bar (12) is a maximum distance from the side surface (28) of the head (16) of running rail (14). As face (30) of guard bar (12) and side wall (28) of rail (14) wear it becomes desirable to move guard bar (12) towards rail (14) to provide the proper distance between guard face (30) and side wall (28). This may be accomplished by removing one or more of selected sizes of shims (144–144") and inserting them between the vertical front surface (48) of support bracket (36) and the vertical rear surface (50) of guard bar (12) as depicted in FIG. 3.

Following the installation of shims (144 through 144"), an elastic fastener (150) which may be a Pandrol clip is installed by driving a leg (152) at one end thereof into bore (90) of fastener receptacle (88) on hook (70). This causes the central section (154) of elastic fastener (150) to engage outer end wall (116) of support block (100) and the other toe end leg (156) to engage the tapered outer end wall (122) of fastener block (100) as may be seen by referring to FIG. 1. Other elastic fasteners such as a McKay Clip or a Linelock Clip also may be utilized.

Consequently, following installation of elastic fastener (150) inner end leg (152) acts to draw hook (70) away from rail (14) to clamp guard bar (12) against vertical surface (48) or against any shims (144–144") therebetween and acts to bias legs (108 and 110) towards support block (100) in the opposite direction to cause the rear surface (106) of support block (100) to be clamped against the vertical rear surface (54) of support bracket (36). Naturally, any shims (144 through 144") are clamped therebetween. Elastic fastener (150) is sized such that when it is installed the toe end leg (156) is deflected approximately 9/16th of an inch and a force of approximately 2,750 pounds is applied to hook (70).

The angle A formed at the intersection of the horizontal rear shelf (52) and the vertical rear surface (54) of support bracket (36) acts to ensure that the components will be locked together and will not have a tendency to move upwardly from rear shelf (52).

Since certain changes may be made in the above-described system and apparatus not departing from the scope of the invention herein and above, it is intended that all matter contained in the description or shown in the accompanying drawings shall be interpreted as illustrative and not in a limiting sense.

We claim:

1. A support block for a guard rail assembly which comprises:

a vertical wall having a front surface, a rear surface defined by a top edge surface, a flat bottom edge surface and a pair of side edge surfaces;

wherein said front and rear surfaces are non-parallel;

a pair of spaced legs which project laterally from said front surface;

wherein one of said legs has a first inner side wall and a first outer side wall which extends parallel to one of said side edge surfaces with a first outer end wall therebetween;

wherein one of said first inner and first outer side walls extends a greater distance from said front surface than said other side wall such that said first outer end wall tapers and is non parallel to said front surface;

wherein the other of said legs has a second inner side wall and a second outer side wall which extends parallel to the other of said edge surfaces with a second outer end wall therebetween; and a notch formed at the bottom edge of said vertical wall between said pair of legs.

2. The support block of claim 1 in which said first outer side wall extends a greater distance from said front surface than said first inner side wall such that said first outer end wall tapers inwardly.

3. The support block of claim 1 in which said second inner side wall and said second outer side wall extend the same distance from said front surface such that said second outer end wall is parallel to said front surface.

* * * * *